United States Patent [19]

Yamaoka et al.

[11] 4,084,900

[45] Apr. 18, 1978

[54] JAM DETECTING DEVICE IN THE ELECTROPHOTOGRAPHIC COPYING MACHINE

[75] Inventors: Sadao Yamaoka; Kenichi Arai, both of Toyokawa, Japan

[73] Assignee: Minolta Camera Kabushiki Kaisha, Azuchi, Japan

[21] Appl. No.: 747,686

[22] Filed: Dec. 6, 1976

[30] Foreign Application Priority Data

Dec. 12, 1975 Japan ..... 50-148926

[51] Int. Cl.[2] ..... G03G 15/00; B65H 7/04

[52] U.S. Cl. ..... 355/14; 271/258; 355/13

[58] Field of Search ..... 271/259, 258; 340/259; 355/13, 14

[56] References Cited

U.S. PATENT DOCUMENTS

| | | | |
|---|---|---|---|
| 3,390,878 | 7/1968 | MacNeill et al. | 271/259 |
| 3,495,822 | 2/1970 | Cederbaum | 271/259 |
| 3,626,956 | 12/1971 | Sauder | 271/259 X |
| 3,663,102 | 5/1972 | Zerfahs | 355/13 X |
| 3,693,969 | 9/1972 | Sakamaki et al. | 271/258 |
| 3,817,134 | 6/1974 | Katayama et al. | 355/13 X |
| 3,948,510 | 4/1976 | Iwamoto et al. | 271/258 |
| 4,013,357 | 3/1977 | Nakajima et al. | 355/13 |

*Primary Examiner*—Bruce H. Stoner, Jr.

[57] ABSTRACT

A jam detecting device for detecting copy paper jamming occurring in an electrophotographic copying machine having a first circuit for detecting the presence of a copy paper which is ready to be fed into various processing stations, a second circuit for detecting the presence of the same copy paper at a position at which it is ready to be discharged out of the copying machine and a timer circuit for measuring the time interval between the detections by the first and second circuits and for producing, in the event the time interval exceeds a predetermined time, a signal indicative of a paper jam occurring in the machine.

12 Claims, 5 Drawing Figures

JAM DETECTING DEVICE IN THE ELECTROPHOTOGRAPHIC COPYING MACHINE

The present invention relates to an electrophotographic copying machine, and more particularly, to a device for detecting copy material such as copy paper jammed or clogged in the copying machine.

BACKGROUND OF THE INVENTION AND PRIOR ART

In an electrophotographic copying machine, an original to be copied is placed over a transparent platform or support and is exposed to light rays from an exposing system usually provided under the support. The light rays reflected by the original have an intensity in accordance with the contrast of the original and are transmitted and projected onto a surface of a photoreceptor usually formed, for example, on a drum or an endless belt for creating an electrostatic latent image of the original thereon. The photoreceptor is, then, pressed against or rolled over the copy paper in a transferring station for transferring the latent image onto the copy paper. Such copy paper is supplied from a roll of paper which is cut and separated from the roll for every cycle of copying operation, or the copy paper is supplied from a stock of sheets of copy paper. The copy paper now having the latent image transferred thereon in the above described manner is conveyed to a developing station where the latent image is developed with developer material such as toner into a visible toner image. Thereafter, the developed copy paper is conveyed to a fixing station where the visible toner image is fixed by any suitable means such as a heater. Finally, the copy paper is conveyed out of the copying machine through a discharging opening onto a tray provided outside the copying machine.

During the time the copy paper is being conveyed through the various stations, there has been a disadvantage, although the posibility may be low, that the copy paper may be caught at some places in the stations so that the copy paper may become jammed in the copying machine.

One conventional type of detecting device for detecting such jams employs a rotary cam arrangement which simultaneously rotates in accordance with the travel of the copy paper, and detects paper jam through detection of the leading edge of the traveling copy paper by a suitable detecting mechanism. Although, such type of detecting device may function to detect the paper jam, it is necessary to furnish the copying machine with said rotary cam arrangement and detecting mechanism. Thus, the copying machine may become large in size and further complicated in its construction. Furthermore, it is impossible for such type of detecting device to detect a paper jam occuring at the detecting mechanism after the leading edge has been detected, since the detecting mechanism only detects the leading edge of the copy paper.

Another conventional type of detecting device employs timer means and means for detecting the leading edge of the copy paper provided adjacent to a copy paper discharging opening. The timer means measures the time during which the copy paper travels through the copying machine and compares such measured time with a predetermined time for the copy paper to travel through the copying machine. In the case where the measured time exceeds the predetermined time, the timer means produces an alarm signal for actuating an alarm system. In this type of detecting device, it is not necessary to furnish the copying machine with various detecting mechanisms such as a rotary cam arrangement. However, it is necessary to preadjust the timer means according to the length of the copy paper, which arrangement thus results in complication of the timer means. Therefore, this type of detecting device is not suitable for a copying machine designed to employ copy paper of various sizes.

OBJECTS AND BRIEF SUMMARY OF INVENTION

Accordingly, a primary object of the present invention is to provide an improved type of jam detecting device which is simple in construction and is suitable for detecting paper jam irrespective of copy paper sizes.

Another object of the present invention is to provide a jam detecting device of the above described type which detects a paper jam with high reliability without any failure regardless of the place where the paper jam is occuring.

A further object of the present invention is to provide a jam detecting device of the above described type which is capable of being employed in any known type of copying machine.

According to the present invention, in an electrophotographic copying machine designed for forming a pattern of an original to be copied on a copying material of various sizes moving along a path having various processing stations, a jam detecting device for detecting a copy material jam occuring between a first position and a second position in said path comprises a starting means which starts a timer means at the time of the passing of the trailing edge of the copy paper over the first position in the coying machine, a paper detecting means which detects the trailing edge of a copy paper which has traveled through the processing stations and is ready to be discharged out of the copying machine through the discharging opening at the second position in said path, timer means actuated according to the operation of said starting means for indicating a predetermined time which is enough long for the copy paper to travel along the path between said first and second position and means for producing an alarm signal indicative of a copy paper jam occuring in said path in the event that the paper detecting means does not detect the trailing edge of the copy paper within the predetermined time and for not producing the alarm signal in the event that the paper detecting means does detect the trailing edge of the copy paper within the predetermined time.

Substantially, the timer means and the timer starting and paper detecting means cooperatively establish the time interval between the moment when the starting means starts the timer means and the moment when the second paper detecting means detects the same copy paper. Any alarm signal is applied to an alarm system for producing an alarm of, for example, a visual or auditory type and for causing the copying machine to stop subsequent cycles of copying operation.

In the jam detecting device of the present invention, the actuation of the starting means is effected by the operation of a paper cutter device provided for cutting and separating a sheet of copy paper from a copy paper supplier employed in the copying machine in the form of a roll.

The actuation of the starting means may be effected by other means, for example, by the operation of illumination means which scans a ribbon of light over the original, since the operation of illumination means is related to the operation of the paper supplier.

Therefore, it is not necessary to provide any particular mechanism for actuating the starting means.

The detection by the second paper detecting means is effected by the operation of switch means, for example, a micro-switch provided adjacent to the discharging opening. The micro-switch first detects the leading edge of the copy paper which has travelled through the various processing stations and then detects the trailing edge thereof. The detection signals produced by the micro-switch are applied to the timer means. The micro-switch can be replaced by any known switch means as long as the switch means is capable of detecting the presence of the traveling copy paper. Since the switch means is provided for merely detecting the copy paper, it is not necessary to provide any complicated mechanism therefor.

The timer means includes a first capacitor used for measuring the time interval described above. The first capacitor is charged from the moment when the first paper detecting means detects the trailing edge of the copy paper until the second paper detecting means detects the trailing edge of the same copy paper.

The timer means further includes a second capacitor which is charged from the moment when the second paper detecting means detects the leading edge of the copy paper until the second paper detecting means detects the trailing edge of the copy paper. In other words, the second capacitor is charged during the time the copy paper moves past the switch means in the second paper detecting means. The charged voltage by the second capacitor is applied, simultaneously with the detection of the trailing edge in the second paper detecting means, to the first capacitor to discharge the same. In the event the charging voltage across the first capacitor exceeds a predetermined voltage because of the failure of the trailing edge of the copy paper to move past the switching means, then the alarm means produces a signal indicative of paper jam for actuating the alarm system.

BRIEF DESCRIPTION OF THE FIGURES

These and other objects and features of the present invention will become apparent from the following description taken in conjunction with a preferred embodiment thereof with reference to the accompanying drawings, wherein.

DETAILED DESCRIPTION OF THE INVENTION

Figure 1:
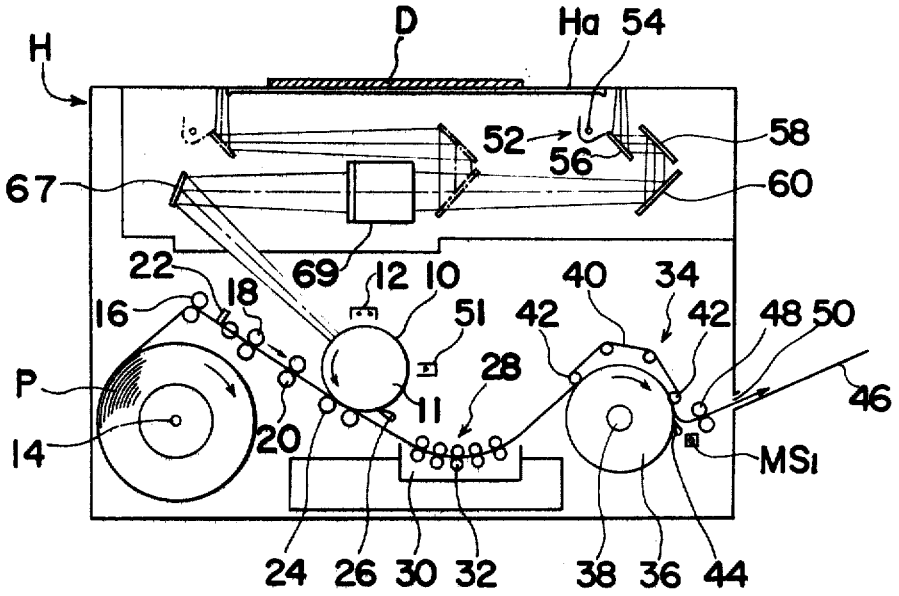
FIG. 1 is a schematic diagram showing a sectional view of a copying machine according to the present invention.

Before the description of the present invention proceeds, it should be noted that like parts are designated by like reference numerals throughout the accompanying drawings.

In FIG. 1, there is shown an electrophotographic copying machine comprising a housing structure substantially divided into upper and lower compartments; the upper compartment accommodates therein an optical system while the lower compartment accommodates therein an electrophotographic processing system. The housing structure is generally designated by H and has a transparent support Ha stationarily mounted on the top of the housing structure H, which transparent support Ha is made of, for example, a transparent glass plate, and is adapted to support the original or document D to be copied. While the optical system will be described in detail later, the processing system will now be described.

The electrophotographic processing system and the method performed thereby are well known to those skilled in the art and, therefore, the various operating elements thereof will be described in terms of their functions.

The electrophotographic copying system comprises a photoreceptor surface, generally indicated by 10, including a photoconductive layer or light receiving layer on a conductive backing and formed in the shape of a drum 11, which is mounted on a shaft (not shown) journaled in a machine frame (not shown) to rotate in the direction indicated by the arrow to cause the drum surface sequentially to pass a plurality of processing stations including charging, exposure or image forming, transfer and erasing stations.

The charging station includes a corona charger 12 which applies a uniform electrostatic charge on the photoreceptor surface 10. Positioned next and adjacent to the charging station with respect to the direction of rotation of the photoreceptor surface 10 is the exposure or imaging station at which rays of light carrying an image of the original D to be copied, which have been transmitted from the transparent support Ha through the optical system, as will be described later, via an exposure slit (not shown) in the form of a ribbon of light, are projected onto the photoreceptor surface 10 dissipate the electrostatic charge in the exposed area thereof thereby forming a latent electrostatic image of the original to be copied.

Between the exposure station and the transfer station, there is provided a paper feeding station including a paper feeding mechanism adapted to feed copy sheets of recording medium, for example, copy paper, successively to the photoreceptor surface 10 in coordination with the presentation of the developed image at said paper feeding station. This paper feeding mechanism comprises a paper supply roll P which is mounted on a shaft 14 journaled in a machine frame (not shown) to rotate in a direction indicated by the arrow to cause the copy paper to be unloaded from the roll P. The paper feeding mechanism further comprises a pair of juxtaposed take-up rolls 16 positioned adjacent to the roll P and adapted to take-up the leading edge of the copy paper when unloading from the roll P and two pairs of juxtaposed conveyor rolls 18 and 20 positioned between the take-up rolls 16 and the transfer station and adapted to convey the copy paper towards the transfer station. Provided between the take-up roll 16 and the conveyor roll 18 is a cutter 22 for cutting the copy paper thereat when a predetermined length of the copy paper has passed the cutter 22. The cutter 22 includes a rotary blade member (not shown) and a stationary sheath member (not shown) which are normally separated from each other. When cutting the copy paper, the blade member is turned towards the sheath member. It should be noted that other types of cutters which are known can be provided instead of the above described type.

At the transfer station, there is provided two transfer rolls 24 having their curved surface pressed against the receptor surface 10 for effecting transfer of the electrostatic latent image on the photoreceptor surface onto the sheet of copy paper when the sheet of copy paper is fed between the photoreceptor surface 10 and the transfer rolls 24.

The sheet of copy paper, to which has been transferred the electrostatic latent image from the photoreceptor surface 10 at the transfer station, is thereafter removed from the photoreceptor surface 10 by a pick-off mechanism 26 and forwarded towards developing device 28 of the wet developing type, mainly comprising a developing tank 30 containing working solution of toner in a liquid state and five pairs of juxtaposed electrode rolls 32 provided in the developing tank 30, wherein the latent image on the copy paper sheet is developed into a visible image. At least one pair of juxtaposed electrode rolls 32 positioned adjacent to the exit of the tank 30 are provided to squeeze the working solution out of the copy paper sheet which has passed through the rest of the electrode rolls.

The copy paper sheet coming from the developing device 28 is fed into a fixing or fusing device 34, comprising a fusing drum 36 having a fusing heater 38 in the central portion thereof for heating the surface of the fusing drum 36 and a fusing belt 40 movably supported by supporting rolls 42, with one portion of the belt 40 extending along the surface of the fusing drum 36. The wet copy paper sheet is inserted between the surface of the fusing drum 36 and the fusing belt 40 for being dried and for fixing the visible image thereon, after which the copy paper sheet is peeled off the surface of the fusing drum 36 by a separation claw 44 provided adjacent to the fusing drum with its edge contacting the fusing drum surface, then ejected from the copying machine onto a copy tray 46 through juxtaposed discharging rolls 48 provided between the separation claw 44 and the copy tray 46, and discharged from the copying machine through a discharging opening 50.

There is provided adjacent to the discharging roll 48 a micro-switch MS1 which detects whether or not the copy paper sheet passes thereby. Such microswitch MS1 is incorporated in a jam detecting circuit J for detecting a paper jam in the machine, which circuit J is described in detail later in connection with FIG. 4.

The developed and transferred sheet which has been separated from the photoreceptor surface 10 at the pick-up station, is subsequently transported during continued rotation of the photoreceptor drum 11 to the erasing station. The erasing station has an eraser 51 which erases residual charge on the photoreceptor surface 10 in readiness for the subsequent cycle of the copying operation. For this purpose, the erasing station is generally located prior to the charging station which has already been described.

Figure 2:
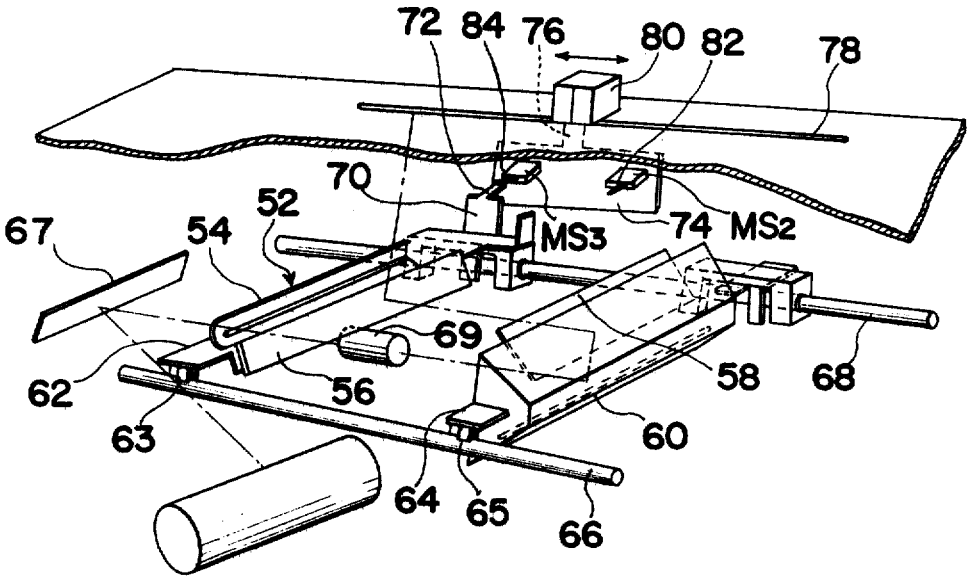
FIG. 2 is a perspective view, partly broken away, of the upper compartment of the copying machine shown in FIG. 1.

Referring also to FIG. 2, the optical system of the electrophotographic copying machine, which is substantially accommodated within the upper compartment of the machine housing H, comprises an illumination device of any known construction, generally indicated by 52, which illumination device 52 includes a source of light or lamp 54 and a reflective mirror arrangement 56 designed such that rays of light emitted from the light source 54 can be projected towards the original D on the transparent support Ha in the shape of a ribbon of light to sequentially illuminate said original D over the entire width thereof. This illumination device 52 as shown in FIG. 2, is rigidly mounted on a gantry 62 reciprocally movably mounted by a rotatable roll 63 on at least one pair of spaced guide rails 66 and 68 which are supported in a position within the machine housing H and extend in substantially parallel relation to the plane of the transparent support H*a*.

Reciprocally movably mounted on the same guide rails 66 and 68 by a rotatable roll 65 is a mirror carriage 64 having a reflective mirror 58 and 60 rigidly mounted thereon for reflecting the ribbon of light from the original D on the transparent support H*a* towards a fixed reflective mirror 67 through a lens assembly 69. The mirror 67 and the lens assembly 69 are supported in position on the machine frame (not shown), so that the mirror 67 reflects and projects the ribbon of light onto the photoreceptor surface 10 at the same incidence angle to form the latent image of the original, as the drum rotates in relation to the movement of the illumination device 52.

As is well understood by those skilled in the art, when the gantry 62 carrying the illumination device 52 thereof is moved from a rest position, as indicated by the full lines, to a scanning position as indicated by the broken lines while the ribbon of light from the illumination device 52 scans the original D on the transparent support Ha, the carriage 64 carrying the reflective mirrors 58 and 60 thereon moves in pursuit of the gantry 62 at a speed half the speed of movement of the gantry 62. Such movements of the gantry 62 and the carriage 64 are produced by means of a driving system (not shown) which can be of any known construction, and the details thereof will not be described for the sake of brevity.

Therefore, the relation in speed between the gantry 62 and the carriage 64 can be expressed by the following equation;

$$V1 = 2V2$$

wherein $V1$ and $V2$ designate the velocity of the gantry 62 and the carriage 64, respectively.

It should be noted that the rotating speed, i.e., the velocity of the drum surface is equal to said velocity V1 for successively forming a similar pattern of the original as a latent image on the drum surface, and that the paper feeding mechanism is designed to transport the copy paper at the velocity of V1.

Accordingly, the distance of the ribbon of the light from the surface of the original to the photoreceptor surface 10 substantially maintained the same during the scanning of the original D.

Fixedly provided on the gantry 62 at the position where it is supported by the guide rail 68 is an actuator member 70 having an actuating claw 72 laterally extending from the gantry 62, so that the actuating claw 72 moves together with gantry 62. During the movement of the gantry 62, from the rest position to the scanning position, the actuating claw 72 actuates switches provided on a switch panel 74. The switch panel 74 has an arm member 76 which is slidably inserted in an elongated opening 78 provided in the machine frame, and is provided with a positioning member 80 at the end of the arm member 76. Since the elongated opening 78 extends in parallel relation to the guide rails 66 and 68, the displacement of the switch panel 74 along the elongated opening 78 is substantially in parallel to the movement of the gantry 62. The switch panel 74, after the position thereof is changed, is fixedly held thereat by a clutch means (not shown) incorporated in the positioning member 80.

Provided on the switch panel 74 are micro-switches MS2 and MS3 aligned in a line parallel to the movement of the gantry 62 and arranged to have respective switching arms 82 and 84 operated by the actuating claw 72 during the movement of the gantry 62. The micro-switch MS2 is provided for operating the cutter 22 which has already been referred to while the micro-switch MS3 is provided for indicating the end of the scan and for returning the gantry 62, as well as the carriage 64, to the rest position.

Before starting a cycle of the copying operation, the operator adjusts the position of the positioning member 80 according to the length of the original placed on the transparent support Ha, and then manipulates a suitable starting switch (not shown) provided on the copying machine. Simultaneously, the illumination device 52, as well as the mirrors 58 and 60, are shifted from the rest position towards the scanning position. During the scan of the illumination device 52, the actuating claw 72 first actuates the micro-switch MS2 to cut off the copy paper from the roll P, and then actuates the micro-switch MS3 so as to stop and return the illumination device 52 in the rest position. Therefore, it is understood that the position of the illumination device 52 shown in FIG. 2 corresponds with the scanning position, and that such scanning position may be changed according to the length of the original through displacement of the switch panel 74.

In the electrophotographic copying machine as described above, there is provided a jam detecting circuit J for detecting a copy paper jam occurring in the electrographic processing system.

Figure 3:
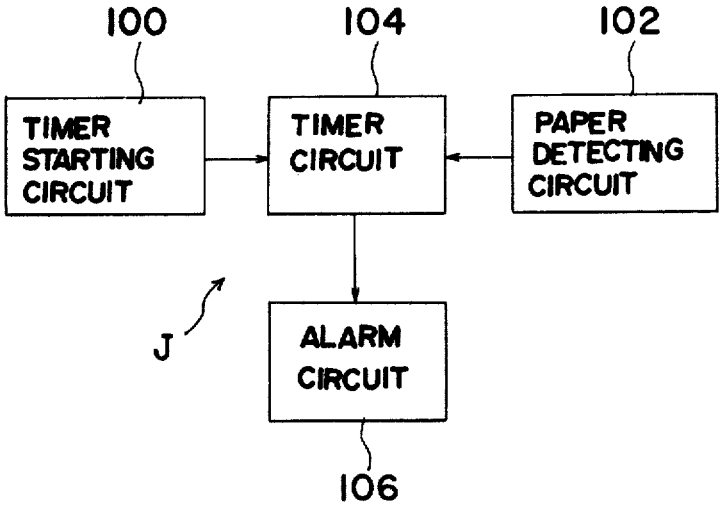
FIG. 3 is a block diagram of a jam detecting device according to the present invention.

Referring to FIG. 3, the jam detecting circuit J of the present invention comprises a timer starting circuit 100 for starting a timer means at the time of 104 the passing of the trailing edge of the copy paper over a first position in the path in the electrophotographic copying machine, a paper detecting circuit 102 for detecting the presence of the trailing edge of the copy paper at a second position at which it is ready to be discharged from the copying machine, the timer means 104 being electrically coupled to said starting circuit 100 and paper detecting circuit 102 for indicating a predetermined period of time, upon actuation of the first paper detecting circuit 100, which period of time is enough long for the copy paper to travel between the first position and the second position along the path past the various processing stations, and an alarm circuit 106 electrically coupled to the timer circuit 104 for producing an alarm signal indicative of a copy paper jam occuring in the copying machine in the event that the second paper detecting circuit 102 does not detect the copy paper within the predetermined period of time while not producing an alarm signal in the event that the second paper detecting circuit 102 detects the copy paper within said predetermined period of time.

Substantially, the timer circuit 104, together with the starting circuit 100 and second paper detecting circuit 102 starts the running of the time interval from a starting moment, corresponding to the operation of the timer starting circuit 100, to an ending moment, corresponding to paper detection by the second paper detecting circuit 102, and the alarm circuit 106 produces the alarm signal when the time interval measured in the timer circuit 104 exceeds the predetermined period of time defined in the alarm circuit 106. Such alarm may be in a visual or auditory type indicating a paper jam occuring at some place in the copying machine. In addition to the generation of such an alarm, the alarm circuit 106 may further cause the copying machine to stop the subsequent copying operation.

Figure 4:
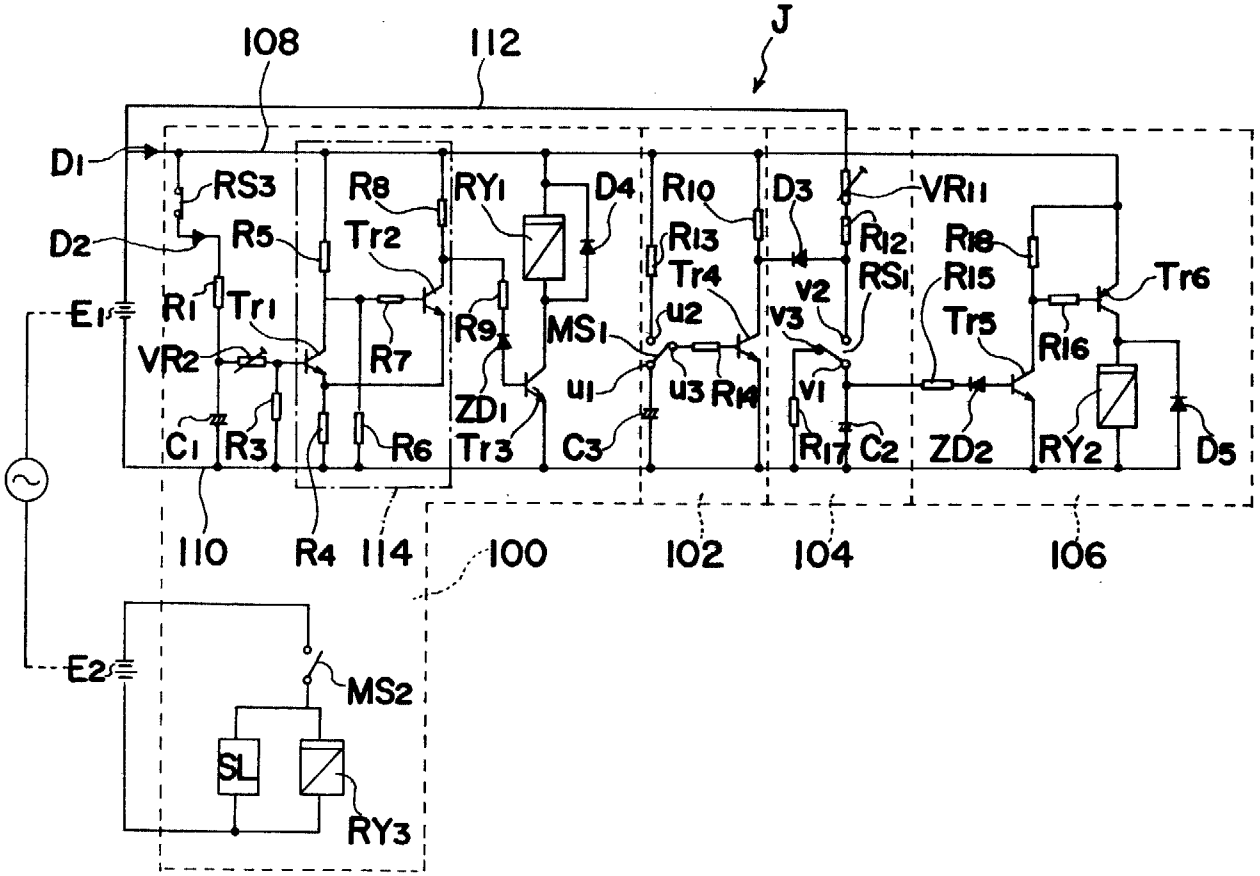
FIG. 4 is a complete circuit diagram of the jam detecting device shown in FIG. 3.

Referring to FIG. 4, there is shown a complete circuit of the jam detecting circuit J which is operated by two independent sources of D.C. power E1 and E2, prepared from a source of A.C. power through a suitable rectifying means (not shown). The first D.C. power source E1 supplies a positive lead line 108 through a forward-biased diode D1 and a negative lead line 110, and also another positive lead line 112 directly from the power source E1.

The second D.C. power source E2 is connected in series with the micro-switch MS2 and a relay RY3 and a solenoid SL for operating the blade member in the cutter 22 is connected in parallel with the relay RY3. In addition to micro-switch MS2, relay RY3 and solenoid SL which are connected to the second D.C. power source E2, the timer starting circuit 100 further comprises a relay switch RS3 actuated to close upon energization of the relay RY3, a diode D2, a resistor R1 and a capacitor C1 which are connected in series and are connected between positive and negative lead lines 108 and 110. A variable resistor VR2 and a resistor R3 connected in series are connected across the capacitor C1. A voltage appearing at the junction between the variable resistor VR2 and the resistor R3 is applied to a Schmidt trigger circuit 114 comprising a transistor Tr1 having the base connected to said junction, the collector connected to the positive lead line 108 through a resistor R5 and also connected to the negative lead line 110 through a resistor R6, and the emitter connected to the negative lead line 110 through a resistor R4 and a transistor Tr2 having the base connected to the collector of the transistor Tr1 through a resistor R7, the collector connected to the positive lead line 108 through a resistor R8 and the emitter connected to the emitter of the transistor Tr1. Connected to the output terminal of the Schmidt trigger circuit 114, which is at the collector of the transistor Tr2, is the base of a transistor Tr3 through a resistor R9 and a reverse-biased zener diode ZD1. The collector of the transistor Tr3 is connected to the positive lead line 108 through a relay RY1 while the emitter is connected to the negative lead line 110. A diode D4 is connected across the relay RY1.

The second paper detecting circuit 102 comprises a resistor R13, the micro-switch MS1 and a capacitor C3 which are connected in series between the positive and the negative lead lines 108 and 110. The micro-switch MS1 has a common terminal u1 connected to the capacitor C3 and two alternative terminals u2 and u3. The terminal u2 is connected to the resistor R13 while the terminal u3 is connected to the base of a transistor Tr4 through a resistor R14. The emitter of the transistor Tr4 is connected to the negative lead line 110 and the collector thereof is connected to the positive lead line through a resistor R10 and also to the timer circuit 104 through a reverse-biased diode D3.

The timer circuit 104 comprises a variable resistor VR11, a resistor R12, a relay switch RS1 and a capacitor C2 which are connected in series between the positive lead line 112 and the negative lead line 110. The relay switch RS1 operated by the relay RY1 has a common terminal *v*1 connected to the capacitor C2 and two alternative terminals *v*2 and *v*3. The terminal *v*2 is connected to the diode D3 and also to the resistor R12 and the terminal *v*3 is connected to the negative lead line 110 through a resistor R17. The terminal *v*1 is further connected to the alarm circuit 106.

The alarm circuit 106 comprises a transistor T*r*5 having the base connected to the terminal *v*1 through a resistor R15 and a reverse-biased zener diode ZD2 connected in series, the emitter connected to the negative lead line 110 and the collector connected to the positive lead line through a resistor R18 and to the base of a transistor T*r*6 through a resistor R16. The emitter of the transistor T*r*6 is connected to the positive lead line 108 while the collector thereof is connected to the negative lead line through a relay RY2 and a diode D5 connected in parallel. The relay RY2 may further operate a visual or auditory type of alarm system (not shown) coupled thereto. The operation of the jam detecting circuit J described above is given hereinbelow in connection with FIG. 4.

Figure 5:
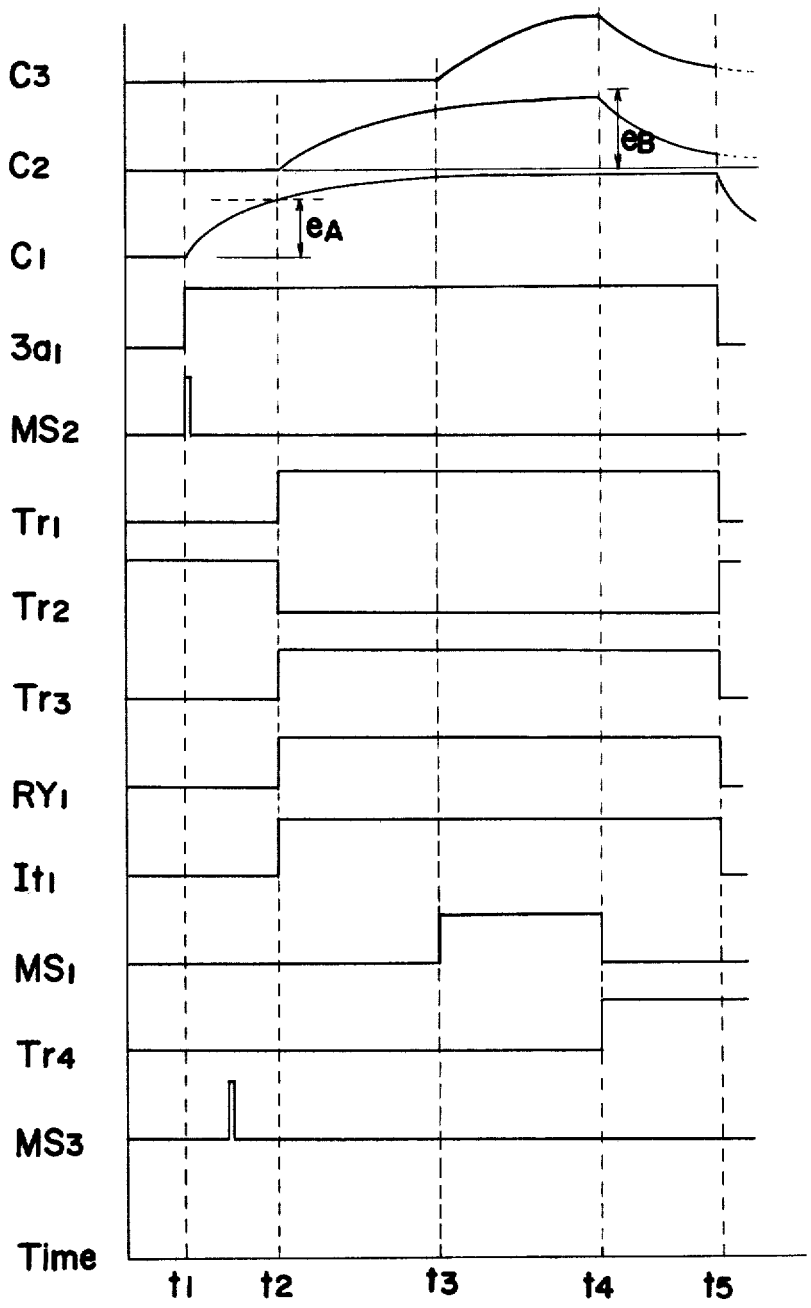
FIG. 5 is a time chart showing the states of various electric elements in the circuit shown in FIG. 4.

Referring to FIG. 5, there is shown a time chart of operations of various electric elements employed in the jam detecting circuit J, wherein the abscissa represents the time for one complete cycle of the copying operation and the ordinate represents variations in the various electric elements represented by the reference characters. Upon turning on of the start switch for starting the copying operation, the illumination device moves from the rest position to the scanning position while the web of the copy paper is fed through the cutter 22 and through the paper feeding mechanism.

During the scanning of the illumination device 52, the actuating claw 72, at the moment t1 shown in FIG. 4, causes the micro-switch MS2 to be switched over from the open position to the closed position for operating the cutter 22. By the operation of the cutter 22, i.e., by the closure of the micro-switch MS2, a predetermined length of copy paper is separated from the roll P and is fed into the various copy processing stations, thereby defining the starting moment in the first paper detecting circuit 100. In addition to the operation of cutter 22, the microswitch MS2 also energizes the relay RY3 which in turn operates the relay switch RS3 to change from open position to the closed position whereby the capacitor C1 connected thereto is charged by the current from the D.C. power source E1. When the charge of the capacitor C1 reaches a predetermined voltage eA, as indicated at a moment *t*2, the transistor T*r*1 is turned from the non-conductive state to conductive state. Thus, the transistor T*r*2 is turned from the conductive state to the non-conductive state. Therefore, a signal is produced from the Schmidt trigger circuit 114, through the reverse-biased zener diode ZD1 to the transistor T*r*3 which is thus turned from the non-conductive state to conductive state, so as to operate the relay RY1. The energization of the relay RY1 causes the relay switch RS1 to change the state thereof in such a manner that the common terminal *v*1 which has been connected with the terminal *v*3 is changed over to connect with the terminal *v*2, whereby the capacitor C2 is now charged by the current from the D.C. power source E1. After the sheet of copy paper has passed the various processing stations within a predetermined time sufficient for the copy paper to pass, the micro-switch MS1 is actuated, at a moment *t*3, by the leading edge of the sheet of copy paper to change its state in such a manner that the common terminal *u*1 which has been connected with the terminal *u*3 is changed over to connect with the terminal *u*2, whereby the capacitor C3 is now charged by the current from the D.C. power source E1. After the sheet of copy paper has passed the micro-switch MS1, the trailing edge thereof, at a moment *t*4, returns the micro-switch MS1 to the original state, so that the common terminal *u*1 is again connected with the terminal *u*3, thereby defining the ending moment in the second paper detecting circuit 102. By the connection between the capacitor C2 and the transistor T*r*4, the charged voltage in the capacitor C3 changes the transistor T*r*4 from the non-conductive state to the conductive state, so that the capacitor C2 which has been charged by the D.C. power source E1 is discharged through a closed circuit consisting of capacitor C2, relay switch RS1, diode D3 and the transistor T*r*4. Therefore, the voltage across the capacitor C2 is reduced before reaching a predetermined voltage *e*B.

However, if a paper jam occurs in the machine during the travel of the copy paper past various processing stations, the micro-switch MS1 will not be actuated by the copy paper within the predetermined time. Thus, the current from the D.C. power source E1 continues to flow towards the capacitor C2 to charge the same. As a result, the voltage across the capacitor C2 exceeds the predetermined voltage *e*B so as to produce a signal through the resistor R15 and the reverse-biased zener diode ZD2 to the transistor T*r*5 in the alarm circuit 106. By the energization of the transistor T*r*5, the transistor T*r*6 is turned from the non-conductive state to the conductive state, and thus the relay RY2 is energized to operate the alarm system connected thereto, indicating the paper jam in the machine.

After having completed one cycle of a copying operation, the relay switch RS3 is returned to the opened state by a suitable actuating means (not shown).

As is well understood by those skilled in the art, the time interval between the starting moment, defined by the actuation of the micro-switch MS2, and the ending moment, defined by the trailing edge of the copy paper passing through the micro-switch MS1, is measured by the charging voltage across the capacitor C2. When the charging voltage is discharged before reaching the voltage *e*B, then the jam detecting circuit J will not produce any alarm signal and the succeeding copying operation is carried out without any unnecessary delay. However, on the other hand, in the event that the charging voltage across the capacitor exceeds the voltage *e*B because of delay or failure of the copy paper in reaching the microswitch MS1, particularly, because of the failure of the trailing edge of the copy paper to move past the switch MS1, then the jam detecting circuit J produces the alarm signal therefrom and will cause the copying machine to stop the succeeding copying operation.

It should be noted that the micro-switch MS2, described as used for defining the starting moment by the actuation thereof in the first paper detecting circuit 100, can be replaced by the micro-switch MS3 provided for returning the illumination device 52.

Since the jam detecting circuit J of the present invention is entirely constructed as an electric circuit without any particular mechanism such as a cam arrangement simultaneously operating with the travel of the copy paper to carry out the detection of the paper jam, it is possible to furnish the jam detecting circuit J in any known type of copying machine such as an original support scanning type instead of an illumination scanning type without much difficulty, as long as there is means to indicate a starting moment to the jam detecting circuit J.

Furthermore, since the jam detecting circuit J is operated upon detection of the trailing edge of the copy paper, at both moments, i.e., at the starting moment and the ending moment, the length of the copy paper has no effect on the operation of the jam detecting circuit.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as included therein.

What is claimed is:

1. In an electrophotographic copying machine for forming a pattern of an original to be copied on sheets of copying material of various sizes moved along a path having various processing stations therealong, a jam detecting device for detecting a copy material jam occurring between a first position and a second position along said path, said second position being adjacent the vicinity of the position along said path at which the copying material is discharged from the machine, and said first position being spaced along said path ahead of said second position with at least processing stations for image formation on the copying material and for fixing the image on the copying material being between said first and second positions, said jam detecting device comprising:

(a) a timer means for setting a period of a predetermined length which is long enough for the copying material to travel along the path between said first and second positions;

(b) a starting means connected to said timer means for starting said timer means at the time of the passing of the trailing edge of the copying material over said first position along said path;

(c) a material detecting means at said second position and connected to said timer means for detecting the passing of the trailing edge of said copying material past the second position along said path; and (d) means connected to said timer means for producing a signal in the event that said material detecting means does not detect the trailing edge of the copying material within said predetermined length of time, which signal is indicative of a copy material jam occurring along said path.

2. A jam detecting device as claimed in claim 1, wherein said timer means comprises a capacitor which is started to be charged upon the operation of said starting means and a voltage determining element for discharging said capacitor when the voltage across said capacitor exceeds a voltage determined by said voltage determining element.

3. A jam detecting device as claimed in claim 1, wherein said material detecting means comprises switch means provided along said path of said copy material and being actuated during the time said copy material is moving past said switch means, a capacitor coupled to said switch means, said capacitor being charged during the time said switch means is actuated and a switching element operated by the voltage across said capacitor when said switch means changes from the actuated state to the non-actuated state.

4. A jam detecting device as claimed in claim 1, said copying means having a cutter for cutting said copy material to a predetermined length before it is fed into said processing stations, said jam detecting means further comprising means for producing a cutter signal indicative of operation of said cutter means, said cutter signal producing means being connected to said starting means for actuating said starting means upon receipt of said cutter signal, thereby defining said first position as the place where said cutter means is provided in said path.

5. A jam detecting device as claimed in claim 1, said copying means having scanning means for producing a ribbon of light to be projected on an original to be copied over the entire surface thereof through relative movement between the original and an illumination means from a rest position to a scanned position, said jam detecting means further comprising means for producing a return signal indicative of operation of said scanning means, said return signal producing means being connected to said starting means for actuating said starting means upon receipt of said return signal.

6. In an electrophotographic copying machine for forming a pattern of an original to be copied on sheets of copying material of various sizes moved along a path having various processing stations therealong, said machine having cutter means along said path for cutting the copying material into various predetermined lengths, a jam detecting device for detecting a copy material jam occurring between a first position and a second position along said path, said second position being adjacent the vicinity of the position along said path at which the copying material is discharged from the machine, and said first position being the position of said cutter means and being spaced along said path ahead of said second position with at least processing stations for image formation on the copying material and for fixing the image on the copying material being between said first and second positions, said jam detecting device comprising:

(a) a timer means for setting a period of a predetermined length which is long enough for the copying material to travel along the path between said first and second positions;

(b) a starting means connected to said timer means for starting said timer means at the time of the operation of said cutter means;

(c) a material detecting means at said second position and connected to said timer means for detecting the passing of the trailing edge of said copying material past the second position along said path; and (d) means connected to said timer means for producing a signal in the event that said material detecting means does not detect the trailing edge of the copying material within said predetermined length of time, which signal is indicative of a copy material jam occurring along said path.

7. A jam detecting device as claimed in claim 6, wherein said timer means comprises a capacitor which is started to be charged upon the operation of said starting means and a voltage determining element for discharging said capacitor when the voltage across said capacitor exceeds a voltage determined by said voltage determining element.

8. A jam detecting device as claimed in claim 6, wherein said material detecting means comprises switch means provided in said path of said copy material and being actuated during the time said copy material is moving past said switch means, a capacitor coupled to said switch means, said capacitor being charged during the time said switch means is actuated and a switching element operated by the voltage across said capacitor when said switch means changes from the actuated state to the non-actuated state.

9. In an electrophotographic copying machine having illumination means for producing a ribbon of light to be projected on an original to be copied by scanning means producing a relative movement between the original and said illumination means from a rest position to a scanned position, and for forming a pattern of an original to be copied on sheets of copying material of various sizes moved along a path having various processing stations therealong, a jam detecting device for detecting a copy material jam occurring between a first position and a second position along said path, said second position being adjacent the vicinity of the position along said path at which the copying material is discharged from the machine, and said first position being spaced along said path ahead of said second position with at least processing stations for image formation on the copying material and for fixing the image on the copying material being between said first and second positions, said jam detecting device comprising:

(a) a timer means for setting a period of a predetermined length which is long enough for the copying material to travel along the path between said first and second positions;

(b) a starting means connected to said timer means for starting said timer means at the time of the end of the relative movement of said scanning means when it reaches the scanned position;

(c) a material detecting means at said second position and connected to said timer means for detecting the passing of the trailing edge of said copying material past the second position along said path; and (d) means connected to said timer means for producing a signal in the event that said material detecting means does not detect the trailing edge of the copying material within said predetermined length of time, which signal is indicative of a copy material jam occurring along said path.

10. A jam detecting device as claimed in claim 9, wherein said timer means comprises a capacitor which is started to be charged upon the actuation of said starting means and a voltage determining element for discharging said capacitor when the voltage across said first capacitor exceeds a voltage determined by said voltage determining element.

11. A jam detecting device as claimed in claim 9, wherein said material detecting means comprises switch means provided in said path of said copy material and being actuated during the time said copy material is moving past said switch means, a capacitor coupled to said switch means, said capacitor being charged during the time said switch means is actuated and a switching element operated by the voltage across said capacitor when said switch means changes from the actuated state to the non-actuated state.

12. In an electrophotographic copying machine for forming a pattern of an original to be copied on sheets of copying material of various sizes moved along a path having various processing stations therealong, said machine having cutter means along said path for cutting the copying material into various predetermined lengths, a jam detecting device for detecting a copy material jam occurring between a first position and a second position along said path, said second position being adjacent the vicinity of the position along said path at which the copying material is discharged from the machine, and said first position being the position of said cutter means and being spaced along said path ahead of said second position with at least processing stations for image formation on the copying material and for fixing the image on the copying material being between said first and second positions, said jam detecting device comprising:

(a) a timer means for setting a period of a predetermined length which is long enough for the copying material to travel along the path between said first and second positions, said timer means having a switch means which is switched from one condition to a second condition upon operation of the cutter means, a first capacitor connected to said switch means which is started to be charged when said switch means is switched, and a switching element connected to said first capacitor and made conducting upon charging of said first capacitor over a predetermined voltage;

(b) a material detecting means at said second position and connected to said timer means for detecting the passing of the trailing edge of said copying material past the second position along said path, said material detecting means having a switch in the path of the copy material and being changed to one position in the presence of the copy paper in said second position and to a second position in the absence of the copy paper in said second position, a second capacitor connected to said switch which is charged when said switch is in the one position, and a switching element connected to said first capacitor and to said switch means and said switch for causing the charge of said first capacitor to be discharged through the said switch means upon changing over of said switch to said one position; and (c) means connected to said timer means for producing a jam indicating signal in the event that said material detecting means does not detect the trailing edge of the copying material within said predetermined length of time, said jam signal producing means being connected to said switching element for generating a jam signal through said switching element at the moment when the charging voltage of said first capacitor exceeds the predetermined value and said switch does not switch to the second position.

* * * * *